US005787784A

United States Patent [19]

Scherzinger

[11] Patent Number: 5,787,784

[45] Date of Patent: Aug. 4, 1998

[54] CIRCULAR BRAIDING MACHINE

[75] Inventor: Werner Scherzinger, Franzfelderstr, Germany

[73] Assignee: SIPRA Patententwicklungs- u. Beteiligungsgesellschaft mbH, Albstadt, Germany

[21] Appl. No.: 771,806

[22] Filed: Dec. 20, 1996

[30] Foreign Application Priority Data

Dec. 22, 1995 [DE] Germany ..... 195 47 930.0

[51] Int. Cl.[6] ..... D04C 3/48

[52] U.S. Cl. ..... 87/44; 87/45; 87/48

[58] Field of Search ..... 87/48, 35, 44, 87/45

[56] References Cited

U.S. PATENT DOCUMENTS

| | | | |
|---|---|---|---|
| 814,711 | 3/1906 | Larsson | 87/35 |
| 1,260,063 | 3/1918 | Rosskothen | 87/45 |
| 1,456,656 | 5/1923 | Tober | 87/48 |
| 1,458,474 | 6/1923 | Tober | 87/45 |
| 1,615,587 | 1/1927 | Klein et al. | 87/48 |
| 4,372,191 | 2/1983 | Iannucci et al. | 87/48 |
| 4,729,278 | 3/1988 | Graeff et al. | 87/48 |
| 5,099,744 | 3/1992 | Hurst et al. | 87/45 |

FOREIGN PATENT DOCUMENTS

| | | |
|---|---|---|
| 0441604A1 | 8/1991 | European Pat. Off. . |
| 2743893 | 9/1980 | Germany . |
| 3937334A1 | 7/1990 | Germany . |
| 4009494A1 | 6/1991 | Germany . |
| 0 166 158 | 7/1921 | United Kingdom . |
| 1 583 559 | 1/1981 | United Kingdom . |
| 2 139 313 | 11/1984 | United Kingdom . |
| 2 226 575 | 7/1990 | United Kingdom . |
| 2 238 798 | 6/1991 | United Kingdom . |
| 2 290 802 | 1/1996 | United Kingdom . |

*Primary Examiner*—William Stryjewski
*Attorney, Agent, or Firm*—Michael J. Striker

[57] ABSTRACT

The circular braiding machine includes an inner and outer group of spools (31,38) arranged on a circular track coaxial with a rotation axis (1); a drive device (9–11, 17, 29, 42–45) for rotating the groups in opposite directions (r,s) around the circular track; strand guide members (48) for guiding strands (37) from one of the groups at a location between that group and a braiding point (35) so as to braid the strands, these strand guide members (48) being mounted to reciprocate along guideways (78) while keeping a constant distance from the braiding point (35); and a device for reciprocating the strand guide members (48) along the guideways (78), which operates synchronously with the drive device and which includes pivotally connected levers (73,77) for coupling the at least one strand guide member with the drive device, at least one rotatable crank device, (68, 69) coupled with the levers (73, 77) and an elliptical gear device (63, 67) coupled with the crank device (68, 69) for rotating the crank device (68, 69) so that the angular velocity of the crank device (68,69) is not constant and is smaller in regions corresponding to the turning points of the at least one strand guide member than a corresponding constant angular velocity of the crank device.

9 Claims, 9 Drawing Sheets

CIRCULAR BRAIDING MACHINE

BACKGROUND OF THE INVENTION

This invention relates to a circular braiding machine which comprises an axis of rotation, a group of inner and outer spools arranged on a circular track coaxial with the axis of rotation and each carrying a strand, drive means for moving the groups of spools in opposite directions, strand guide members for guiding at least the strands of one of the groups of spools at a location between the latter and a braiding point, and means with levers operating synchronously with the drive means and being coupled to the strand guide members for crossing the strands of the inner and outer spools.

Two main kinds of braiding machines are known. In one kind, predominantly used in the past, the spool carriers themselves execute their movement in crossing paths needed for the interlacing or cross-overs of the threads or strands (maypole principle). However, the other kind is used predominantly today, in which the two groups of spools execute circular movements in opposite senses and only the strands of one group are passed alternately over and under the spools of the other group (high-speed braiding principle). The invention is concerned only with the second kind of circular braiding machine as mentioned above. There are various systems for the to an fro movement of the strands, i.e. for moving the strands forwards and backwards.

The greatest number of known circular braiding machines operate with swinging levers which are pivotally mounted at one end and have strand guide members at the front end and are moved to and fro with the aid of cranks, eccentrics or control camways (e.g.DE-PS 2 743 893, EP 0 441 604 A1) . The strand guide members then perform a substantially sinusoidal movement. This results in a whip-like to and fro swinging of the swinging lever at high speeds of rotation of the circulating spool groups, which leads to high bending stresses and thus to overswing of the swinging lever at the points of reversal and is problematic for constructional reasons (e.g. high wear). Moreover the sinusoidal course of movement has the result that the number of spools which can be fitted round the circumference of the machine has to be comparatively smaller or the spacing between the spools has to be made comparatively greater, if instead of a simple "1 over—1 under" crossing (or braid configuration) a higher order such as a "2 over—2 under", "3 over—3 under" braid configuration or the like is to be provided, because sinusoidal curves run comparatively flat in the crossover region. This disadvantage can be truly avoided in part if the swinging moment of the swinging lever is accelerated in crossover regions and retarded in the regions of reversal compared with a pure sinusoidal movement (DE 3 937 334 A1), with the aid of a drive linkage coupled to a crank arm. The whip effect and the constructional problems associated therewith can however only be reduced to a small extent by this.

In order to avoid the whip effect it is already known to arrange the strand guide member at one end of a constantly rotating crank slide linkage and so to control the circulating movement of the crank slide linkage that the strand guide member describes the path of a coiled epicycloid (DE 4 009 494 A1) . The result of this is that the crank slide linkage with the strand guide member has the greatest angular velocity in the crossover operation but only moves very slowly or is held nearly stationary in between two crossovers, in order to be able also to carry out braid configurations of "2 over—2 under" in this way. However in this solution also the course of the curve in the crossover region is in part relatively flat, so that the spool spacing has to be comparatively large and "2 over—2 under" patterns and higher value patterns cannot be carried out sufficiently economically. Apart from this there is the danger that the individual strands twist up or twist together, especially when the strands are treated, sticky material.

In the light of this it has already been proposed (see U.S. Ser. No. 08/496.395 of the same applicant) to mount said strand guide members, movable backwards and forwards, on linear or curved guideways intended to maintain essentially constant distances from the braiding point, and to couple at least one strand guide member with a lever which is under the control of a gear mechanism which has a crank and creates a superimposed sinusoidal movement of such a kind that the angular velocity of the crank is smaller in the regions corresponding to reversal points of the guideway and greater in the regions lying in between than corresponds to a purely sinusoid rotational movement. The gear mechanism is designed as an eccentric gear or a pick-off gear (summing drive unit). Such gears are comparatively complex and, therefore, susceptible to wear and different kinds operating trouble.

SUMMARY OF THE INVENTION

It is, therefor, an important object of this invention to propose a circular braiding machine of the type discussed above but having a drive mechanism of high operating reliability.

A further object of this invention is to control the movements of the guide members by means of gear mechanisms of high reliability and low wear.

Yet a further object of this invention is to design the circular braiding machine of the kind initially referred to such that whip-like movements of the parts moving the strand guide members are largely avoided.

A further object of this inventions is to design the braiding machine such that comparatively small spool spacings can be realised even if whip-like movements are largely avoided. Yet another object of the invention is to make possible braid patterns up to "3 over—3 under" or even higher value patterns under economic conditions.

These and other objects of this invention are solved by a braiding machine which is characterized in that the gear mechanism is an ellipitcal gear.

Further advantageous features of the invention arise from the sub-claims.

BRIEF DESCRIPTION OF THE DRAWINGS

The invention is explained in greater detail below by embodiments, given by way of example, in connection with the enclosed drawing. The diagrams show.

DESCRIPTION OF THE PREFERRED EMBODIMENTS

Figure 1:
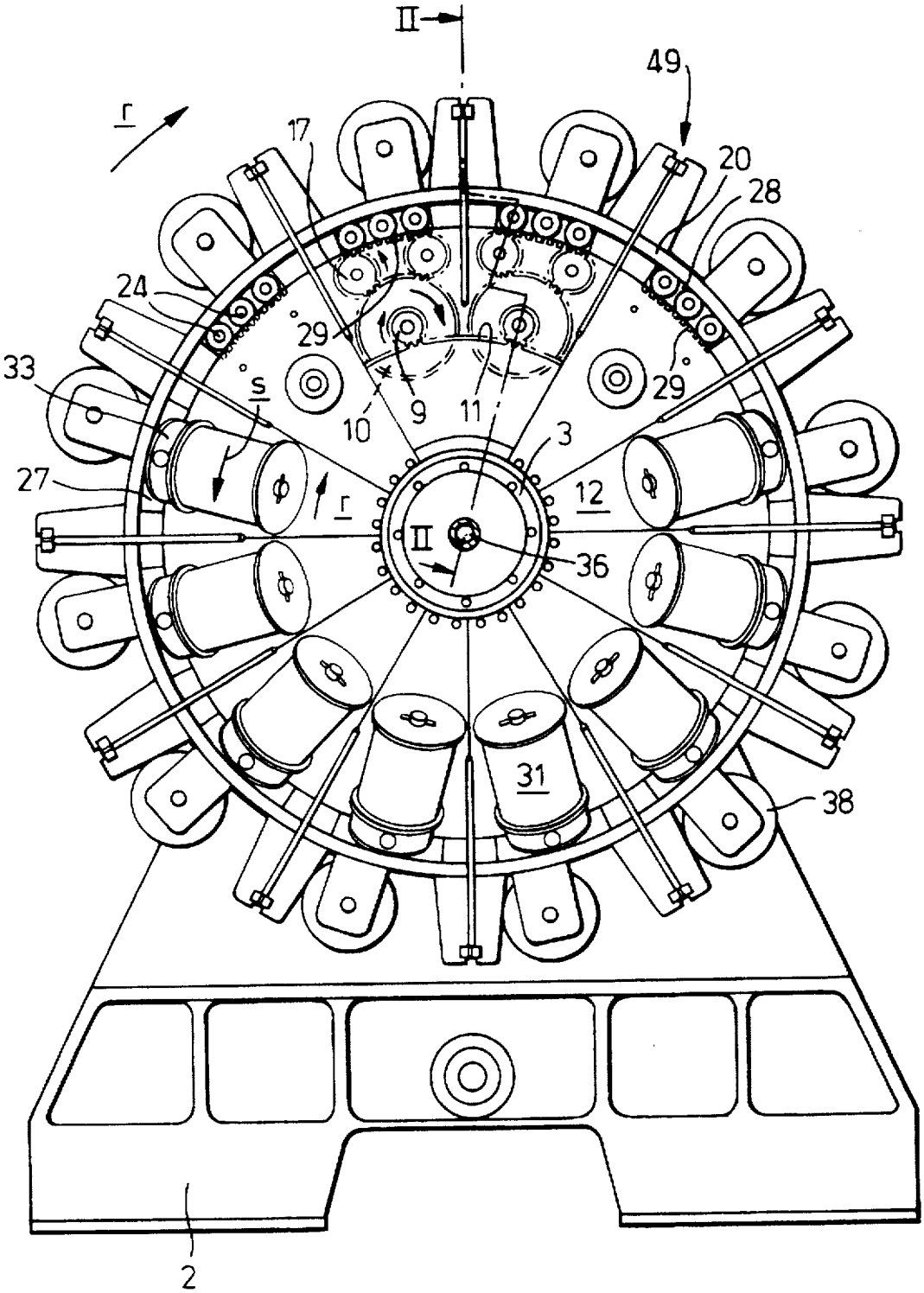
FIG. 1: a partially broken away front elevation of a circular braiding machine according to U.S. patent application Ser. No. 08/496.395.
Figure 2:
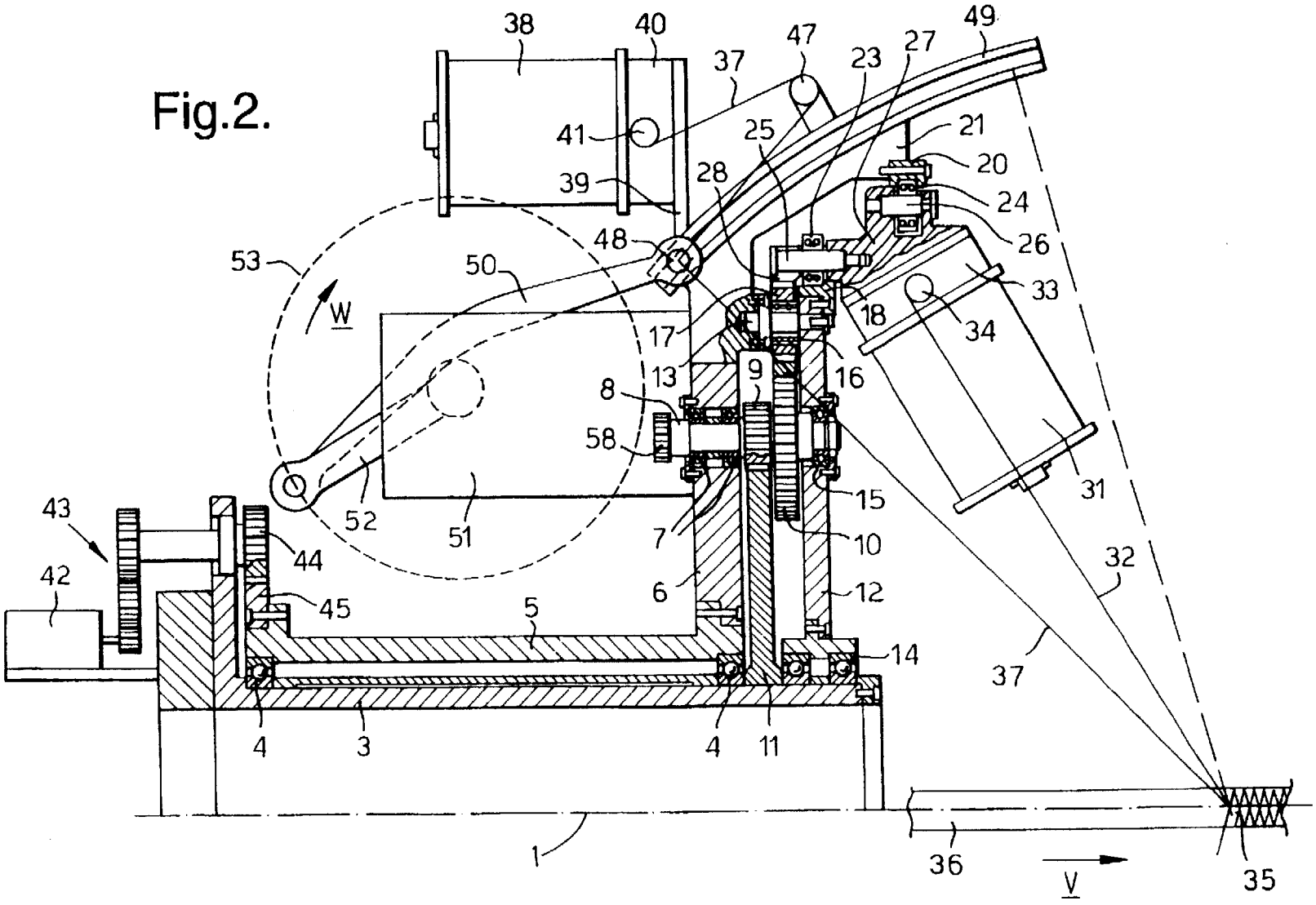
FIG. 2: a vertical section approximately along line II—II of FIG. 1 through the upper half of the circular braiding machine, on an enlarged scale.

FIGS. 1 and 2 show as an embodiment, given by way of example, a circular braiding machine according to U.S. patent application Ser. No. 08/496,395 of the same applicant (see also GB 2 290 802 A, published Jan. 10, 1996) with a horizontally arranged rotational axis 1 (FIG. 2). To a basic frame 2 is fastened a rotor carrier 3 (FIG. 2), on which a hub 5 is mounted, by means of bearing members, rotatable around the rotational axis. The hub 5 carries an annular rotor 6 which is essentially circular and disposed vertically. In this rotor are fitted a plurality of bearing members 7, distributed at a constant radial distance from the rotational axis 1 and at the same angular distances around said axis 1, in which members shafts a orientated parallel to the rotational axis 1 are mounted rotatably. On these shafts 8, towards the front side, are arranged axially the one behind the other, first of all a pinion 9 and then a gearwheel 10. Bach pinion 9 meshes in a gearwheel 11 which is arranged in front of the rotor 6, coaxially with the rotational axis 1 and stationary. When the rotor 6 turns, the pinion 9 rolls away like a planet wheel acting on the gearwheel 11 as a sun wheel.

In addition, the rotor 6 carries a likewise essentially annular circular support 12, which is fastened to the rotor 6 by means of journals 13 disposed radially outside the shafts 8 and parallel to same, in front of which rotor,6 gearwheel 10 is disposed and mounted rotatably on the inside in addition on the rotor carrier 3 by means of bearing members 14. Moreover, the support 12 supports the front ends of the shafts 8 by means of further bearing members 15. Between the rotor 6 and the support 12, intermediate pinions 17 are mounted rotatably by means of bearing members 16 on the journals 13, which mesh with the gearwheels 10. As FIG. 1 shows, in the embodiment, given by way of example, twelve shafts 8 with pinions 9 and gearwheels 10 are arranged around the rotational axis, there being associated with each gearwheel 10 two intermediate pinions 17, whose journals lie on a circuit coaxial with the rotational axis 1.

On the outer perimeter of the support 12 there are attached at equal distances segments 18, into which are worked roller paths which are open radially outwards, i.e. upwards in FIG. 2 , e.g. in the shape of grooves. corresponding segments 20 are secured to the rotor 6 by means of spaced carrying straps 21, roller paths which are open radially inwards, i.e. downwards in FIG. 2, and are likewise in the shape of grooves, for example, being worked into the segments 20. Moreover, segments 20 are disposed axially in front of segments 18 and at greater radial distances than the latter from the rotational axis 1.

The roller paths of segments 18, 20 serve to receive rollers 23 or 24, which are mounted rotatably on trunnions 25 or 26 with axes parallel to the rotational axis 1. These journals 25, 26 are secured to spool carriers 27, which, like the segments 18, 20, are distributed at equal distances around the rotational axis 1. To the journal 25 are fastened, moreover, annular sections 28 with internal toothings 29 (FIG. 1) which intermesh with the intermediate pinions 17. The annular sections 28, looked at in the peripheral direction of the rotor 6, are of such a length that each annular section 28 on turning relatively to the rotor 6 independently of its current position always meshes with at least one of the intermediate pinions 17, yet between the individual annular sections 28 there are radial spaces or slots. The rollers 23,24 are correspondingly fitted in the spool carriers 27 in such a way that each spool carrier 27 is led with positive fit on turning relative to the rotor 6 independently or its current position always with at least two rollers 23,24 in each segment 18,20, yet between the individual spool carriers there are radial slots or spaces. Both the roller path of the segments 18,20 and the toothings 29 lie here each on circuits coaxial with the rotational axis 1.

The spool carriers 27 carry a first group of front or inner spools 31, from which one thread (wire) or strand 32 each is led over a roller 34 steered by a tension control 33 to a braiding point 35, at which the braided article 36, carried in the direction of the rotational axis 1 (arrow v in FIG. 2) and coaxial to same, is braided.

Additional threads or strands 37 are supplied by a second group of rear or outer spools 38, which are fastened to the carrying straps 21 by means of retainers 39 and are likewise led towards the braiding point 35 over rollers 21 steered by tension controls 40. Corresponding to FIG. 1, twelve front or rear spools 31 or 38 each are provided, for example.

The drive of the circular braiding machine is effected by means of a drive motor 42 mounted in the basic frame 2, which motor drives a driving pinion 44 via a gear 43, this pinion meshing with a gearwheel 45 fastened to the hub 5.

Switching on the drive motor 42 results in the hub 5 and the rotor 6, the support 12, the segments 18 and 20 as well as the rear spools 38 being turned or rotating in a preselected direction, e.g. clockwise, as indicated in FIG. 1 by an arrow r. This causes the pinions 9 on the perimeter of the gearwheel 11 to roll off and thus both these as well as the gearwheels 10 are turned clockwise. The intermediate pinions 17, on the other hand, are driven anti-clockwise. Through appropriate dimensioning of the different gearwheels or pinions, the rotation of the intermediate pinions is effected with such a high number of rotations that the toothings 29 intermeshing with them or the spool carriers 27 in the roller paths of segments 18,20, and with them the front spools 31, are moved anti-clockwise (arrow in FIG. 1), and preferably with the same, but opposite, angular velocity as the rotor 6.

In order to wind the braided article 36 round with intersecting strands 32,37 in the manner characteristic for braiding, the strands of the one group of spools must be moved periodically backwards and forwards between the spools of the other group. In this process, the strands 37 of the rear spools 38 are generally moved between the front spools 31, to which end, at least during the crossing over movements, there must be sufficiently large radial slits or spaces not only between the front spools 31, but also between the parts carrying them, such slits or spaces being provided in the embodiment, given by way of example, between e.g. the segments 18,20 and spool carriers 27 but also between the carrying straps 21 or in the rotor 6 and, if necessary, also in the support 12.

Circular braiding machines of this kind are generally known to the expert and therefore do not need to be explained in greater detail. To be on the safe side, reference is made to the publications mentioned initially and particularly to U.S. patent application Ser. No. 08/496,395 of the same applicant whose contents are hereby incorporated by reference into the present application.

In the embodiment, given by way of example, the strands 37 of the rear spools 38 are moved periodically through the front spools 31. To this end, the strands 37 of each spool 38 are first led to a deflection roller 47 and from there through a strand guide member 48, e.g. a lug, to the braiding point 35. The strand guide members 48 are led, corresponding with FIG. 2 and 2A on slightly curved guideways 49 (FIG. 2) or on essentially linear guideways 49*a* (FIG. 2A) and moved backwards and forwards by means of an essentially long extended lever 50 each, which is driven by gears 51. Except the guideways 49, 49*a* the embodiements of FIG. 2 and 2A are identical.

Figure 2A:
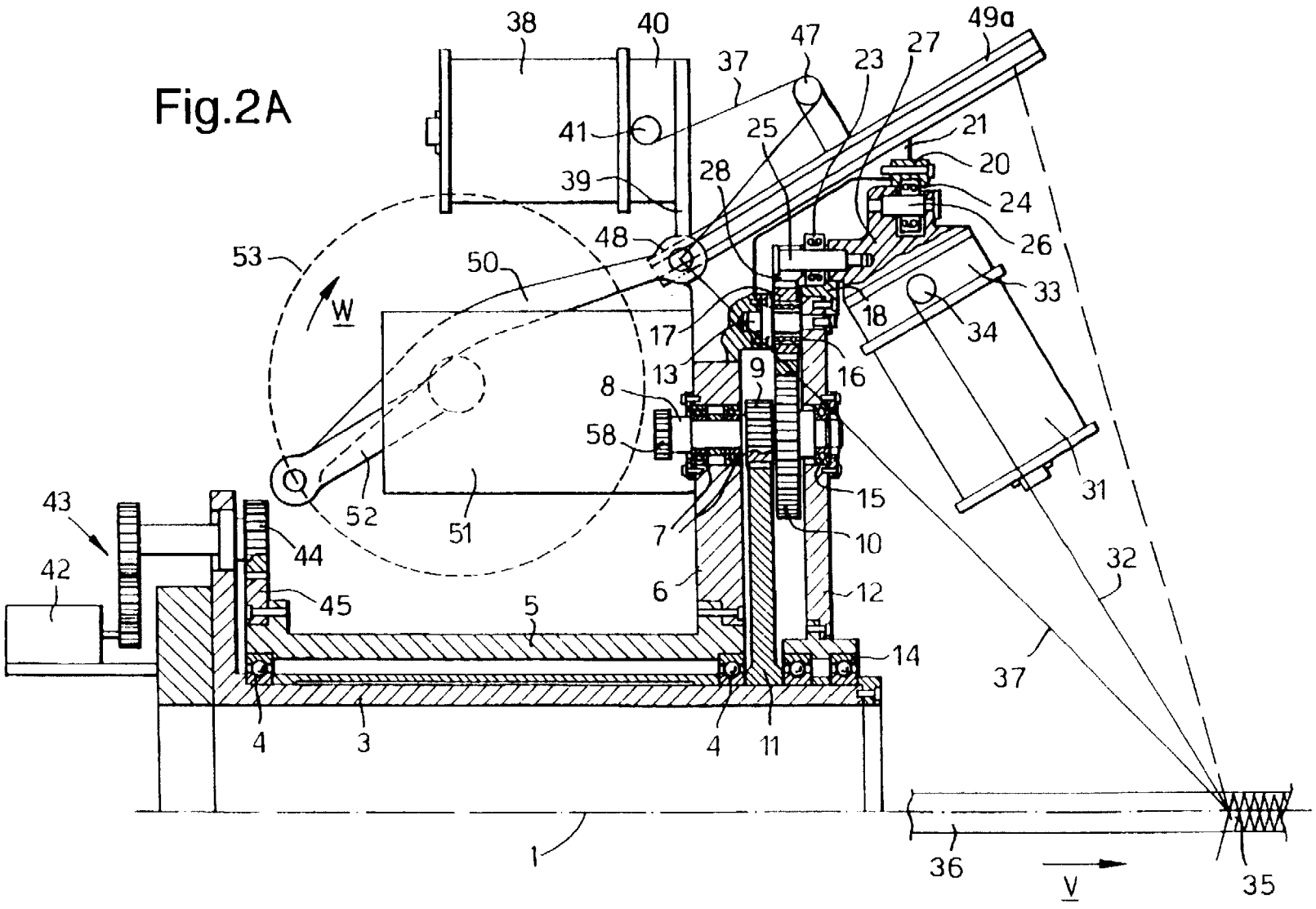
FIG. 2*a*: a section according to FIG. 2 through a further embodiment of the braiding machine.

As FIG. 2 and 2A show, each guideway 49, 49A is arranged at a radial distance from the rotational axis 1 and preferably essentially in a common plane with same, the extension of its axis forming by preference an acute angle with the rotational axis 1. The axes of the guideways 49, 49A of all the strand guide members 48 thus lie essentially on a cone of revolution with the axis of revolution 1 as the rotational axis. If the distance of each end of a guideway from the braiding point 35 is substantially the same, then the distances of all locations of guide member 48 along the guideway from the braiding point are only slightly different even if the guideway 49*a* is linear. According to a particular preferred form of embodiment, the guideway 49 (FIG. 2) is, however, slightly curved in the plane formed with the rotational axis 1, this being along a circular path with a radius corresponding to the distance from the braiding point 35. In this way it is possible to keep the distance of the strand guide member 48 from the braiding point 35 completely constant along the whole movement path.

Figure 3:
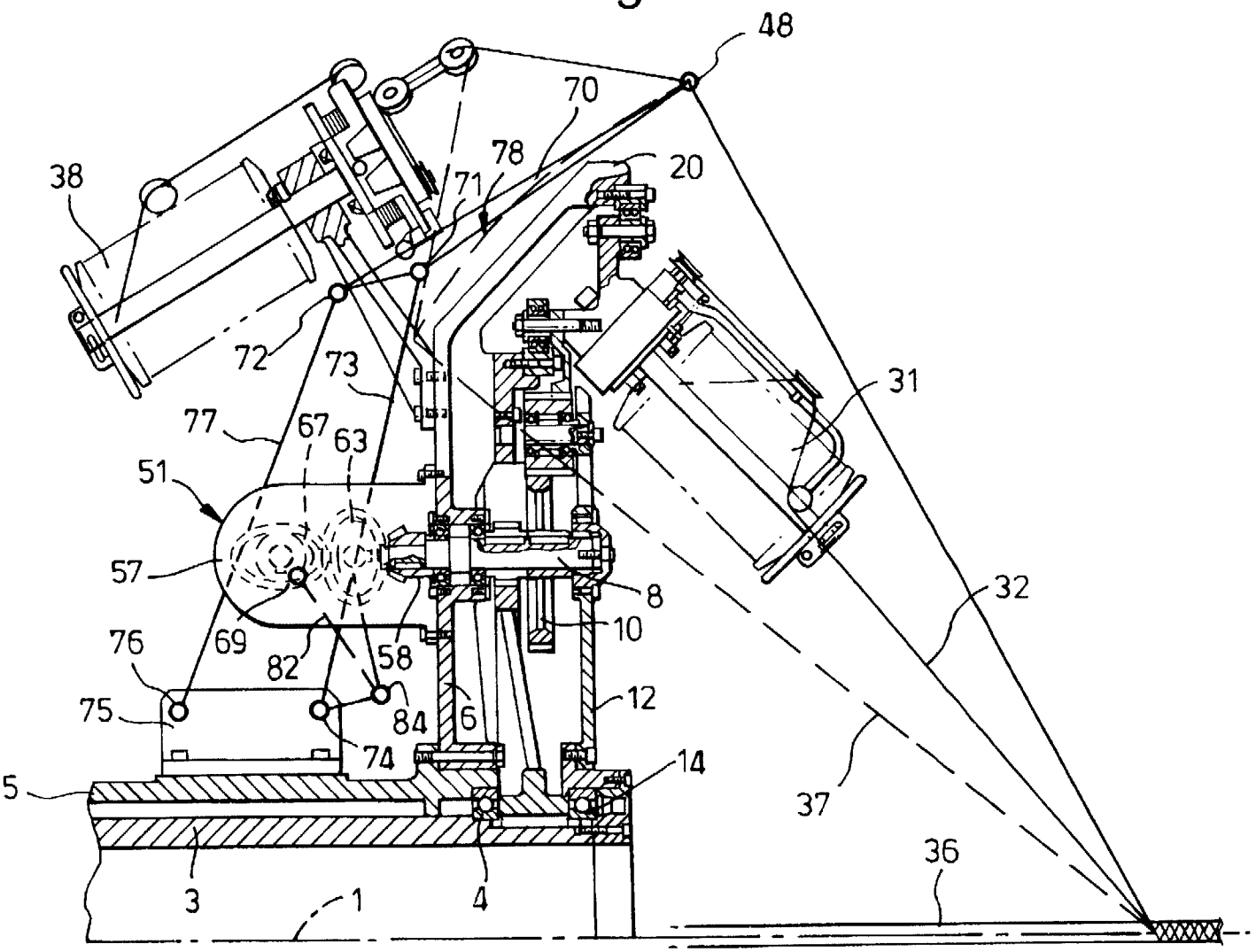
FIGS. 3 and 4: each a vertical section corresponding to FIG. 2 through a circular braiding machine according to the invention, showing a strand guide member in different positions.
Figure 4:
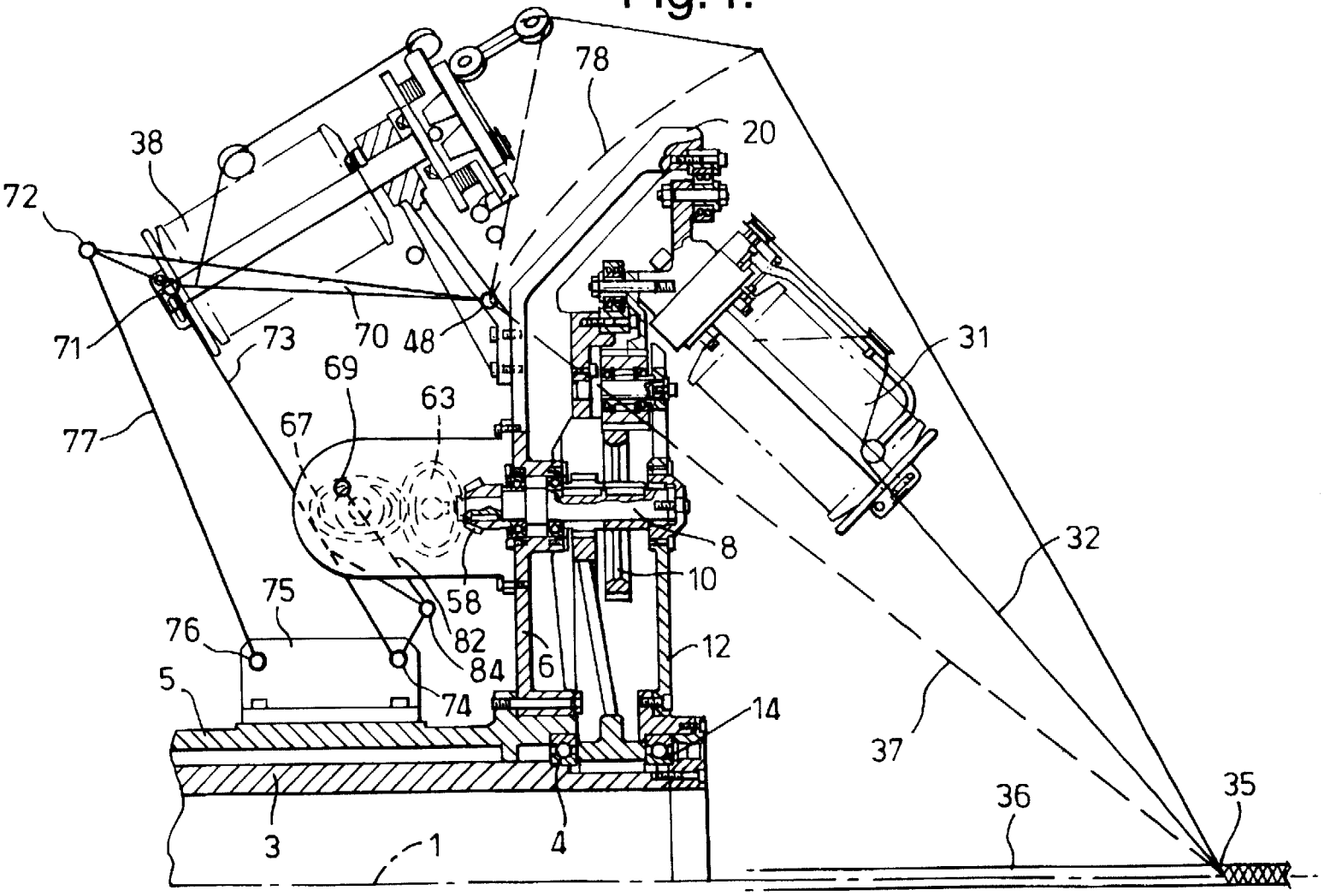

What is also essential is that each lever 50 in the two reversal points of the associated strand guide member 48, i.e. when the latter reaches the ends of the guideway 49, 49*a* is arranged essentially in the extension of the guideway 49, 49*a*. This is shown in (FIG. 2) for the completely retracted position of the lever 50. In this way, the lever 50 is subject to tensile or compressive stress, but not to bending stress, and thus no substantial overswings or vibrations can occur even at high operating speeds, as is unavoidable on known circular braiding because of the whipping effect. By preference, the lever 50 is moreover moved in such a way that it forms, in each position of the strand guide member 48, always an acute angle, deviating considerably from 90°, with guideway 49,49*a* or the respective tangent, i.e. is subject to only slight bending stress even in intermediate positions. The lever 50 thus carries out, similarly to a connecting rod, a translatory motion occurring essentially in the direction of its longitudinal axis. In this process, the end of the lever distant from the strand guide member 48 is also at no time moved jerkily backwards and forwards, but, in accordance with FIG. 2, guided circulating (arrow w) on a circuit 53 by means of a crank lever 52, by which means exposure of the whole strand guide system to mechanical stress is largely avoided, even at high operating speeds. All these advantages are retained without the necessity of moving the strand guide member 48 itself on a circular path and thus, too, twisting of the individual strands is not possible. The guideway 49, 49*a* consists by preference of a slide guided on rails, which slide carries the strand guide member 48 designed as a lug or similar and is hinged to one end of the lever 50. The gearing can be designed in different ways and preferably laid out in such a way that the speed of the strand guide member 48 is smaller at the ends of the guideway 49, 49*a* and greater in the middle part of the guideway 49, 49*a* than would be the case with a purely sinusoidal movement. According to U.S. patent application Ser. No. 08/496,395 of the same applicant, the gearing 51 is designed either as eccentric or pick-off. According to the present additional invention, on the other hand, the gearing 51 is designed as elliptical, which is described in greater detail below with the aid of FIGS. 3 to 7. In FIGS. 3 and 4 the same parts are provided with the same reference numbers as in FIGS. 1 and 2, and thus the parts already explained above do not need to be described again. Moreover, in FIGS. 3 and 4 only the parts necessary for understanding the invention are shown again.

According to FIGS. 3 to 6, each set of gears 51 contains a gear housing 57 which is screwed to the rotor 6 and also receives a driving pinion 58, shown in FIGS. 3 and 4, in the form of a bevel gear wheel which is fastened to the end of the respective shaft 8 distant from the support 12. The driving pinion 58 drives a bevel gear wheel 59 (FIG. 5) This is fastened on a shaft 60, which is mounted pivotally in the gear housing by means of bearings 61, 62 and also carries an oval wheel 63 fastened to it. Parallel to the shaft 60, a second shaft 64 is mounted pivotally in the gear housing 57 by means of bearings 65, 66. A second oval wheel 67 is fastened on this shaft and arranged in the gear housing 57. The two oval wheels 63,67, provided e.g. with involute gear teeth and coaxial with their center lines to the shafts 60,64, intermesh with one another, oval wheel 63 being the driving wheel and oval wheel 67 being the driven wheel.

At one end of shaft 64 projecting from the gear housing 57, there is secured a circular disc 68 which can also be arranged sunk into the oval wheel 67 and carries at a distance from the axis of the shaft an eccentric bolt 69 which is parallel to same and which protrudes outwards over the circular disc 68 and the gear housing 57. This eccentric bolt 69, circulating with the oval wheel 67, forms together with the circular disc 68 a crank, the crank radius corresponding to the distance of the eccentric bolt axis from the axis of the shaft 64.

As FIGS. 3 and 4 show in particular, the strand guide member 48, differently from FIGS. 1 and 2, cannot be moved along a rigid guideway 49,49*a*, but is fastened to a long extended supporting member 70, which can be moved as a whole and is, for example, designed as a lug projecting through the latter. For the sake of simplicity, the supporting member 70 is shown in FIGS. 3 and 4 as a lever- or lancet-shaped component with a triangular cross-section and having three corners, the strand guide member 48 being arranged in one corner which is at a comparatively large distance from the two other corners. Moreover, an intended middle plane of the support member 70 lies in the plane of projection according to FIGS. 3 and 4, which also contains the rotational axis 1, i.e. the support member 70 assumes a relative position to the remaining components which corresponds approximately to the position of the guideway 49 in FIG. 2.

The two other corners of the support member 70 are designed, according to FIGS. 3 and 4, as hinge points 71 and 72 with hinge axes lying perpendicular to the plane of projection and perpendicular to the rotational axis 1. Hinged to the hinge point 71 is one end of a lever 73 whose other end is mounted swivellable in a hinge point 74 of a bearing block 75. The bearing block 75 circulates with a group of spools, here the outer spools 38 and for this purpose is connected tightly, e.g. to the hub 5. On a second hinge point 76 of the bearing block 75 there is mounted, swivellable, one end of a second lever 77, the other end of which is hinged with the hinge point 72 of the support member 70, the hinge axes of the hinge points 74,76 being parallel to those of the hinge points 71,72. The four hinge points 71,72,74 and 76 are arranged like a parallelogram, according to FIGS. 3 and 4, and form together with the support member 70, the bearing block 75 and the levers 73,77 a 4-bar mechanism to swing the strand guide member 48.

FIG. 3 shows the strand guide member 48 in one of its extreme positions, corresponding to the right end of the guideway in FIG. 2, whilst FIG. 4 shows the strand guide member in its other extreme position corresponding to the left end of the guideway 49,49*a* in FIG. 2. From this it is clear that the strand guide member 48 moves between these two extreme positions along a path 78 shown as dashes and having essentially the same course as the guideway 49,49*a* in FIG. 2 Differently from in FIG. 2, however, the path 78 is not a securely mounted guideway but a three-dimensional curve section on which the strand guide member 48 moves, when the support member 70 is pushed with the aid of the 4-bar mechanism out of its position according to FIG. 3 into that according to FIG. 4 or the other way round. The 4-bar mechanism ensures that the support member 70 and the strand guide member 48 cannot move transversely to the path 78 and transversely to the lane of projection of FIGS. 3 and 4. Besides, it is understood that the path 78 could also run, similarly to FIG. 2, almost linear and with an acute angle to the rotational axis 1, and that its center lies by preference in the backward extension of the strand 32, so that the distance from the braiding point changes as little as possible during the movement of the strand guide member 48. To this extent there are, therefore, no differences with regard to the movements actually carried out by the strand guide members 48.

As FIGS. 3 and 4 also make clear, the support member 70 carries out between the two extreme positions of the strand guide member 48 essentially only a translatory motion occurring in its longitudinal direction. In this way the occurrence of whip-like movements is avoided.

Figure 5:
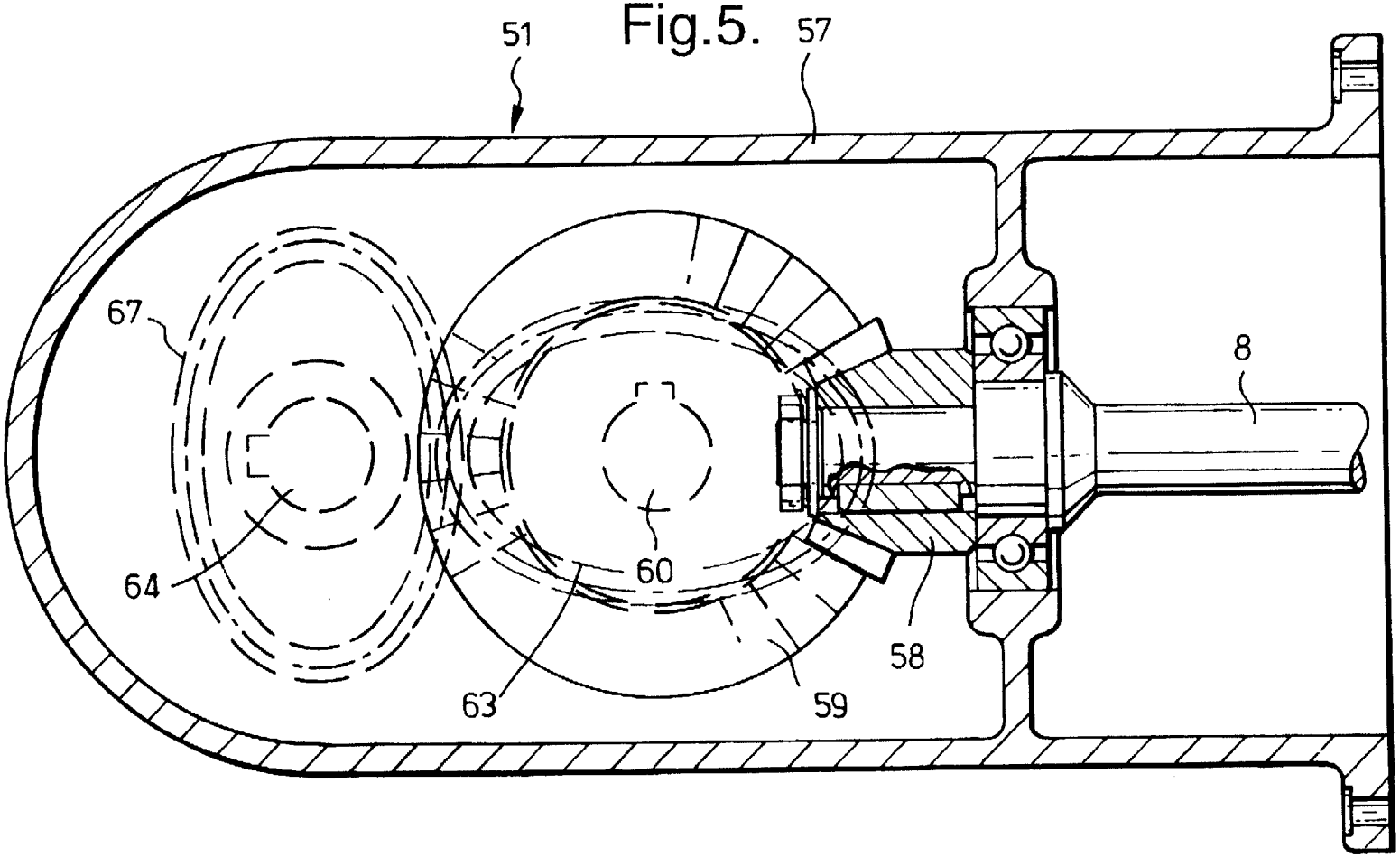
FIG. 5: a vertical section similar to FIGS. 3 and 4 through an elliptical gear for driving a strand guide member, shown in enlargement.
Figure 6:
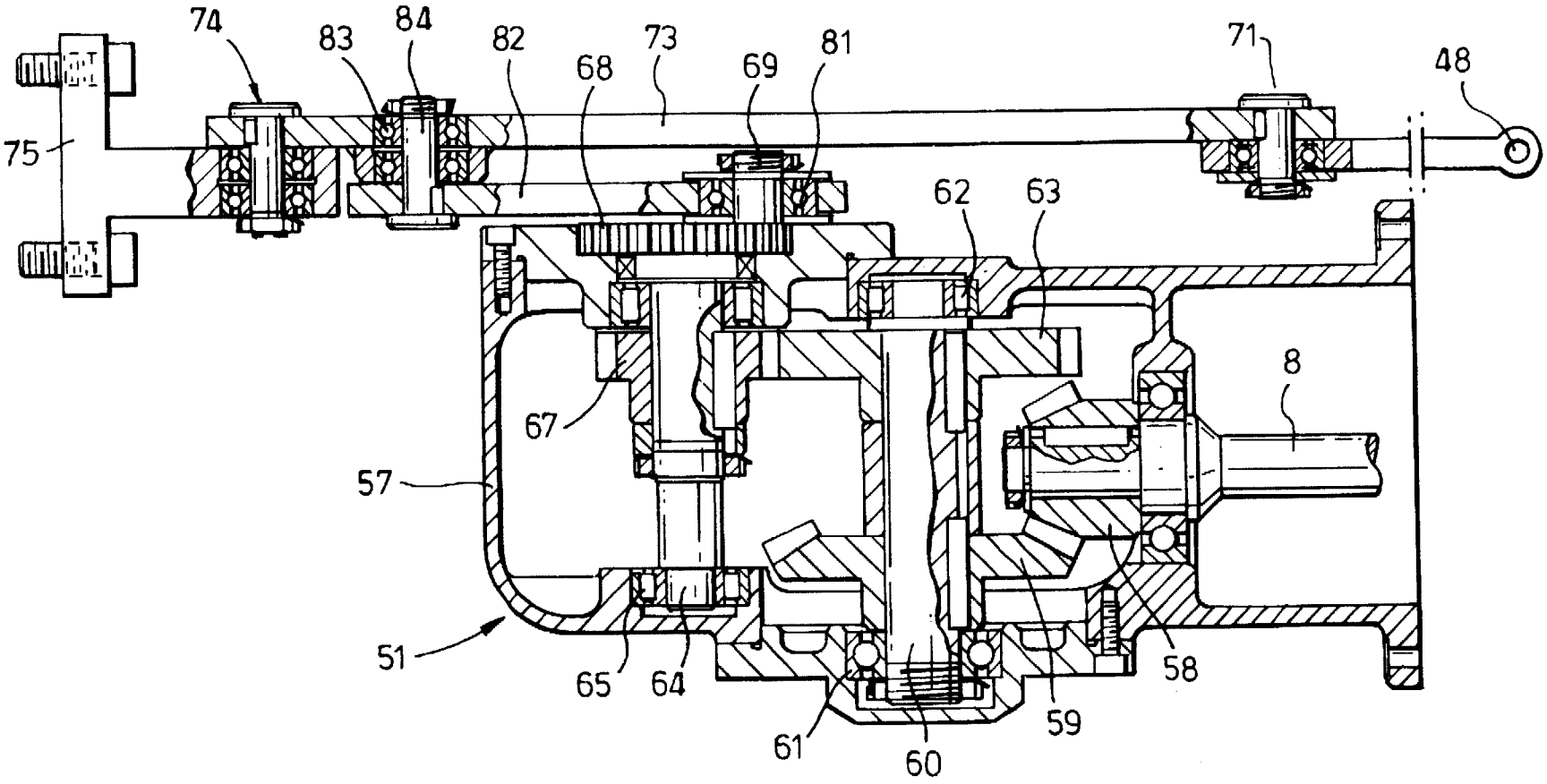
FIG. 6: a horizontal section through the gear along line VI—VI of FIG. 5.

The eccentric bolt 69 (FIG. 6), which is also indicated diagrammatically in FIGS. 3 and 4, serves to drive the 4-bar mechanism 71,72,74,76. For this purpose, the eccentric bolt 69 is mounted by means of a bearing 81 in one end of a connecting rod 82, the other end of which is pivotally connected by means of a bearing 83 and a trunnion 84, which can be seen in FIGS. 3,4 and 6, with the lever 73. The lever 73 has, for this purpose, on the end with the hinge point 74, a widening indicated on the diagram by a triangular extension, so that the axis of the trunnion 84 can be disposed also at a point outside an intended straight connecting line between the two hinge points 71,74. It is understood here that the connecting rod 82 and the levers 73,77 can be moved in parallel planes and the axes of the eccentric bolt 69 and of the trunnion 84 are disposed parallel to the hinge axes of the hinge points 71,72,74 and 76. Moreover these hinge points, as FIG. 5 shows, are preferably realised by bearing and trunnion corresponding to parts 83,84.

The operation of the elliptical gear described is substantially as follows:

Actuation of the driving pinion 78 (FIG. 6), initiated by the rotation of the rotor 6 and synchronised with same, results in a rotation of the two oval wheels 63,67 in the direction of the arrows drawn on FIGS. 3 and 4. In this process, the eccentric bolt 69 turns with different angular velocities on a circular path around the center axis of the driven oval wheel 67. If, for example, the eccentric bolt 69 wanders out of its position indicated in FIG. 3 through clockwise rotation of the oval wheel around 180° into a position indicated in FIG. 4, then the lever 73 is swung, via the connecting rod 82, around the hinge point 74 and, with it, lever 67 around the hinge * point 76 into a position of the 4-bar mechanism 71,72,74 and 76 which can be seen from FIG. 4. At the same time, a displacement of the strand guide member 48 into the end position which can be seen from FIG. 4 is brought about via the support member 70. With another clockwise rotation of the oval wheel around 180°, the positions which be seen from FIG. 3 are then reached again.

The desired movement path for the strand guide member 48 can here be fixed above all by corresponding dimensioning of the distances of the hinge points 71,72,74 and 76 from one another, by the relative position of the trunnion 84, by the size of the oval wheels 63 and 67 as well as of the crank radius and by appropriate choice of the distance between the braiding point 35 and the hinge points 74,76. Besides, a forwards and backwards movement of the strand guide member 48, similarly to the accompanying description of the embodiment, given by way of example and according to FIGS. 1 and 2, results in the strands 37 coming to lie optionally below or above the strands and in this way the desired braid is produced.

Figure 7:
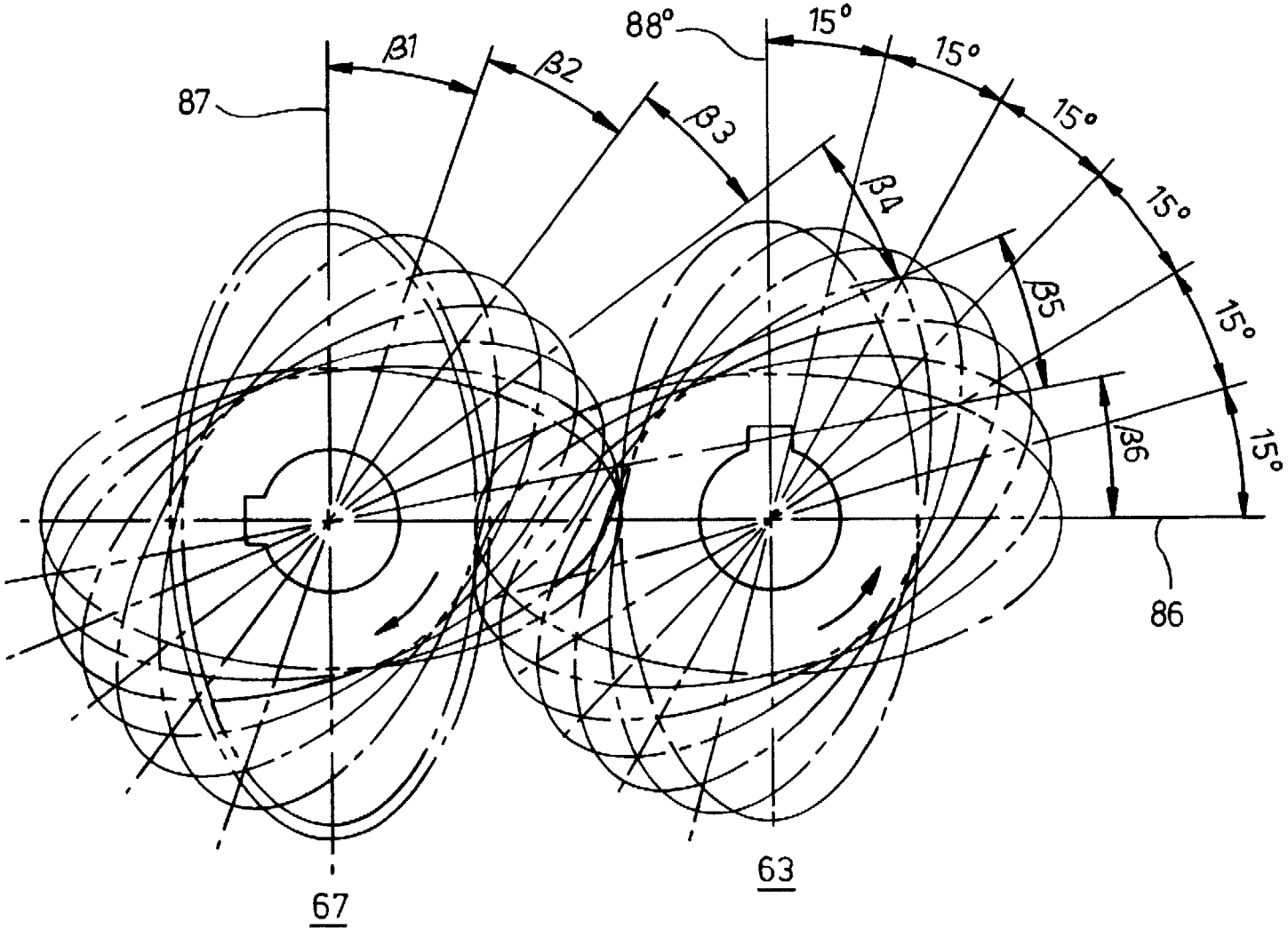
FIG. 7: diagrammatically different positions of the two oval wheels of the gearing according to FIGS. 5 and 6.

FIG. 7 shows how the angular velocity of the driven oval wheel 67 changes with constant angular velocity of the driving oval wheel 63. It is assumed here that the oval wheel 63 turns with its long axis, starting from a line 86, in 6 steps, each of 15°, anti-clockwise, and the oval wheel 67, likewise with its long axis and starting from a line 87, turns clockwise in associated steps corresponding to the angles 1 to 6. It can be seen from this that the angle 1 is greater than 15° and the largest angle of rotation corresponding to a step of 15°, whilst the rotation angles 2 to 6, corresponding to the additional steps of 15° each, are increasingly smaller and particularly angle 6 is smaller than 15°.

If the oval wheel 63, starting from the position reached after 90° (line 88) were to be rotated by an additional 90° anti-clockwise and, with it, the oval wheel 67 rotated clockwise beyond the line 86, the angular velocity of the oval wheel corresponding to the angles 6 . . . 1 would gradually decrease. Through appropriate layout of the oval wheels 63 and 67, through appropriate choice e.g. of the position of the eccentric bolt 69 or of the connecting rod 82 (FIGS. 3,4) in the reversal points of the strand guide member 48 and through choice of the position of the hinge point on the lever 73 represented by the trunnion 84, it is possible in this way to ensure that the rate of motion of the strand guide member 48 is comparatively great in the middle region of the path 78, yet comparatively small in the end sections of the path and, above all, in the reversal points. In this way whip-like movements of the levers 73,77 are to a large extent avoided at the same time.

Figure 8:
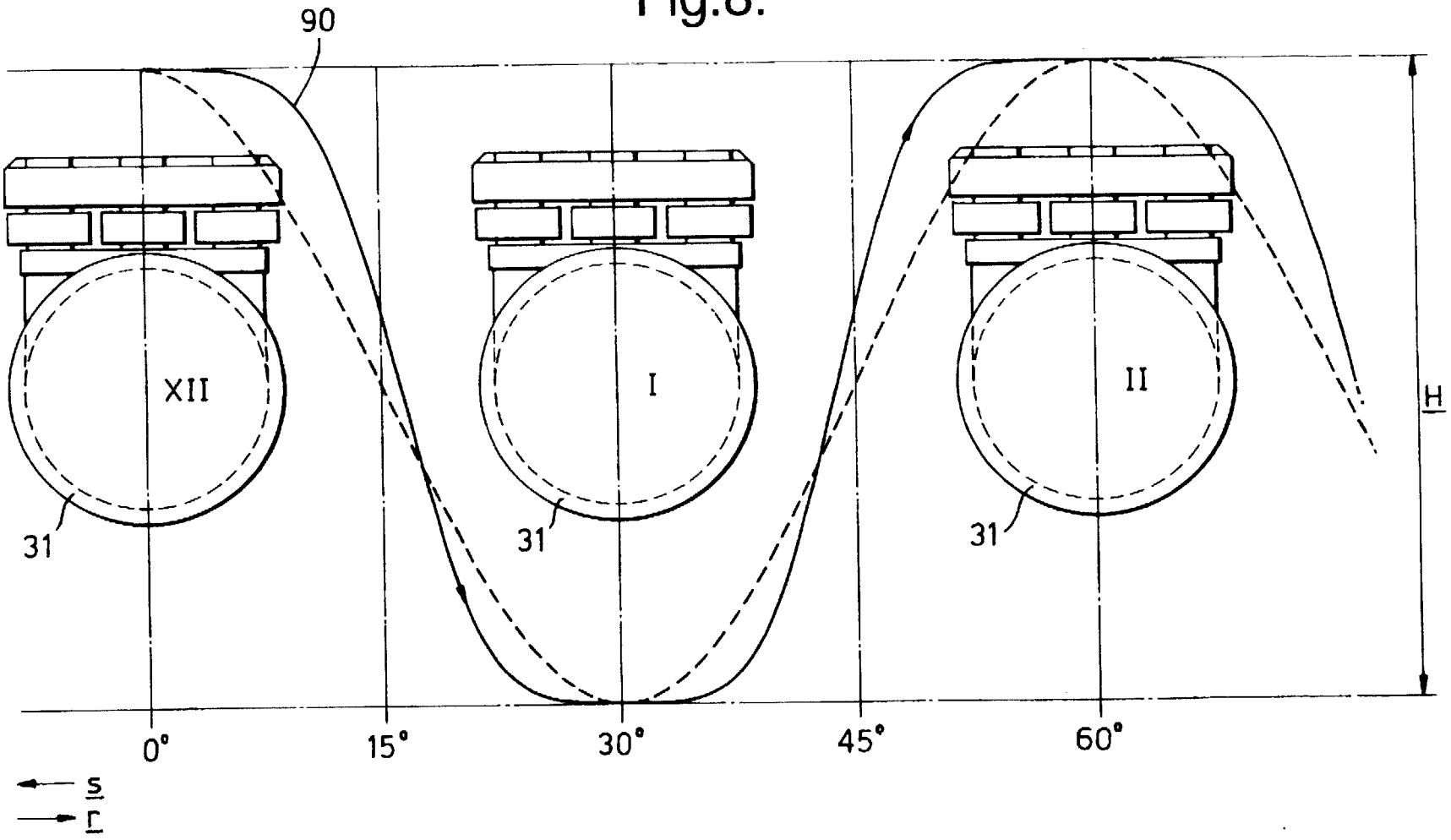
FIG. 8: a diagrammatic view of the path which is travelled by a strand guide member on operation of the circular braiding machine according to FIGS. 3 to 7.

FIG. 8 shows diagrammatically a path 90 which is described by the strand guide member 48 (FIGS. 3,4) on rotation of 20 the rotor 6 in the direction of the arrows drawn in, the movement of the rear and front spools 38 or 31, according to FIG. 1, being indicated with the arrows r and s.

Since there are preferably twelve spools 31 and 38 each, their angular distance amounts to 30° each. The whole stroke of the strand guide member 48 is indicated by H. FIG. 8 makes clear that the largest portion of the stroke H is realised between two spools 31, e.g. between about 10° and 25° (spools XII and I) or between about 40° and 55° (spools I and II). As a result of this, at least in the "2 over—2 under" pattern, which can be seen from FIG. 8, comparatively large spools 31,38, i.e. having a large original angle diameter, can be used without the danger arising that the intersecting strands come into contact in an undesired manner with each other or with parts of the machine and thereby unfavourably influence the braiding process. By choosing the described parameters, the movements of the strand guide members 48 can be suited to the circumstances of the individual case and modified in relation to purely sinusoidal movements.

The invention is not limited to the embodiment described and given by way of example which can be changed in many ways. This is particularly true of the means which are used in the individual case for realising the elliptical gears. It would, in addition, be possible to effect the backwards and forwards movement of the strand guide member with means other than those shown. The circular braiding machine described with the aid of FIGS. 1 and 2 also only represents one embodiment, given by way of example, since the gearing described, with a corresponding modification of the overall construction, can be applied in principle to all circular braiding machines, even those with vertical axis, which are provided with strand guide members moving backwards and forwards to produce the necessary crossings over.

I claim:

1. A circular braiding machine, comprising an axis of rotation (1); a group of inner spools (31) and a group of outer spools (38) arranged on a circular track coaxial with the axis of rotation (1) and each carrying a strand (32,37); drive means (9–11, 17, 29, 42–45) for moving the groups of spools in opposite directions (r,s) around the circular track; strand guide members (48) for guiding at least the strands (37) of one of the groups of spools (38) at a location between the one of the groups of spools and a braiding point (35) and for crossing the strands (32, 37) of the inner and outer spools (31, 38), said strand guide members (48) being mounted to reciprocate along guideways (78) having opposite turning points so that respective distances of the strand guide members (48) from the braiding point (35) are maintained substantially constant during reciprocating movements of said strand guide members; and means for reciprocating said strand guide members (48) along said guideways (78), said means for reciprocating operating synchronously with said drive means; and wherein said means for reciprocating includes lever means (73,77) for coupling at least one of said strand guide members (48) with said drive means, at least one rotatable crank means (69, 69) coupled with said lever means (73, 77) and an elliptical gear means (63, 67) coupled with said crank means (68, 69) for rotating said crank means (68, 69) so that an angular velocity of said crank means (68,69) at regions corresponding to said turning points of said at least one strand guide member (48) is smaller than, and at regions between said turning points is greater than, a corresponding constant angular velocity of said crank means (68, 69).

2. The circular braiding machine as defined in claim 1, wherein one of the groups of said spools (38) is mounted on a rotor (6) having a hub (5) and said lever means (73, 77) is mounted in a bearing block (75) securely connected to the hub (5) of the rotor (6).

3. The circular braiding machine as defined in claim 2, wherein said lever means (73, 77) comprises two levers (73, 77), each of said levers being pivotally mounted on said bearing block (75) and hingedly connected with a supporting member (70) of said at least one strand guide member (48).

4. The circular braiding machine as defined in claim 1, wherein said elliptical gear means (63,67) includes a driving oval wheel (63) and a driven oval wheel (67) with an oval wheel axis; the crank means (68,69) has a crank radius and includes an eccentric bolt (69) having an eccentric bolt axis; the eccentric bolt (69) is arranged parallel and eccentric to the oval wheel axis and circulates with the driven oval wheel (67) and the crank radius is equal to a distance of the eccentric bolt axis from the oval wheel axis.

5. The circular braiding machine as defined in claim 1, wherein the lever means (72,73) includes a lever (73) and the crank means (68,69) is pivotally connected to a connecting rod (82) pivotally connected to the lever (73).

6. The circular braiding machine as defined in claim 5, wherein the lever (73) comprises an articulated lever, connected at one end thereof to said at least one strand guide member (48) and at another end opposite to said one end pivotally with a part circulating with one of the groups of said spools and coupled in a center section with the crank means (68,69).

7. The circular braiding machine as defined in claim 1, wherein the at least one strand guide member (48) is mounted on an elongated support member (70) pivotally connected to the lever means (72,73), and the lever means (73,77) includes one articulated lever (73) and another articulated lever (77) pivotally connected at one end with the elongated support member (70) and at the other end pivotally mounted in a part circulating with one of the groups of said spools.

8. The circular braiding machine as defined in claim 7, wherein said articulated levers (73,77) form a 4-bar mechanism with hinged joints (71,72,74,76) and having a parallelogram shape.

9. The circular braiding machine as defined in claim 7, wherein the articulated levers (73,77) are arranged relative to one another and coupled with the support member (70) so that said support member is driven substantially in a direction in which said support member extends when said at least one strand guide member (48) reciprocates.

* * * * *